US005996309A

United States Patent [19]

Focke et al.

[11] Patent Number: 5,996,309

[45] Date of Patent: Dec. 7, 1999

[54] PACKAGING MACHINE WITH A ROTARY FOLDING UNIT FOR MANUFACTURING (SOFT) POUCH-TYPE PACKETS FOR CIGARETTES

[75] Inventors: Heinz Focke, Verden; Hans-Jürgen Bretthauer, Bremen, both of Germany

[73] Assignee: Focke & Co. (GmbH & Co.), Verden, Germany

[21] Appl. No.: 08/977,660

[22] Filed: Nov. 24, 1997

[30] Foreign Application Priority Data

Nov. 29, 1996 [DE] Germany ..... 196 49 543

[51] Int. Cl.[6] ..... B65B 11/06; B65B 49/00

[52] U.S. Cl. ..... 53/228; 53/232; 53/234; 53/575

[58] Field of Search ..... 53/234, 228, 232, 53/466, 575, 148; 493/164, 910, 911

[56] References Cited

U.S. PATENT DOCUMENTS

| | | | |
|---|---|---|---|
| 4,428,177 | 1/1984 | Focke et al. | 53/234 |
| 4,845,924 | 7/1989 | Focke et al. | 53/234 |
| 4,852,335 | 8/1989 | Focke et al. | 53/234 |
| 5,613,344 | 3/1997 | Osti et al. | 53/234 |

FOREIGN PATENT DOCUMENTS

| | | |
|---|---|---|
| 226872 | 7/1987 | European Pat. Off. . |
| 275481 | 7/1988 | European Pat. Off. . |
| 2302477 | 7/1975 | Germany . |
| 3545884 | 7/1987 | Germany . |
| 3802644 | 8/1989 | Germany . |
| 675630 | 7/1952 | United Kingdom . |

*Primary Examiner*—James F. Coan
*Assistant Examiner*—Gene L. Kim
*Attorney, Agent, or Firm*—Sughrue, Mion, Zinn, Macpeak & Seas, PLLC

[57] ABSTRACT

In the manufacture of certain types of packets, rotary folding units (10) are used which have along their perimeter a plurality of hollow folding mandrels (14) projecting at one side. On these mandrels, blanks, namely inner blank (10) and pouch blank (11) are folded in succession. Holding bands (34, 59) serve to position the blanks exactly on the folding mandrels (14), said bands extending outside the movement region of the folding mandrels (14) and lying with a holding bight (35) against the side of the folding mandrels (14), or the blanks, lying radially on the outside, fixing same as they do so.

10 Claims, 8 Drawing Sheets

IV
V
10
13
14
16
23
24
25
26
27
30
31
32
33
34
35
36
37
38
39
40
48
50
51
66

Fig. 8
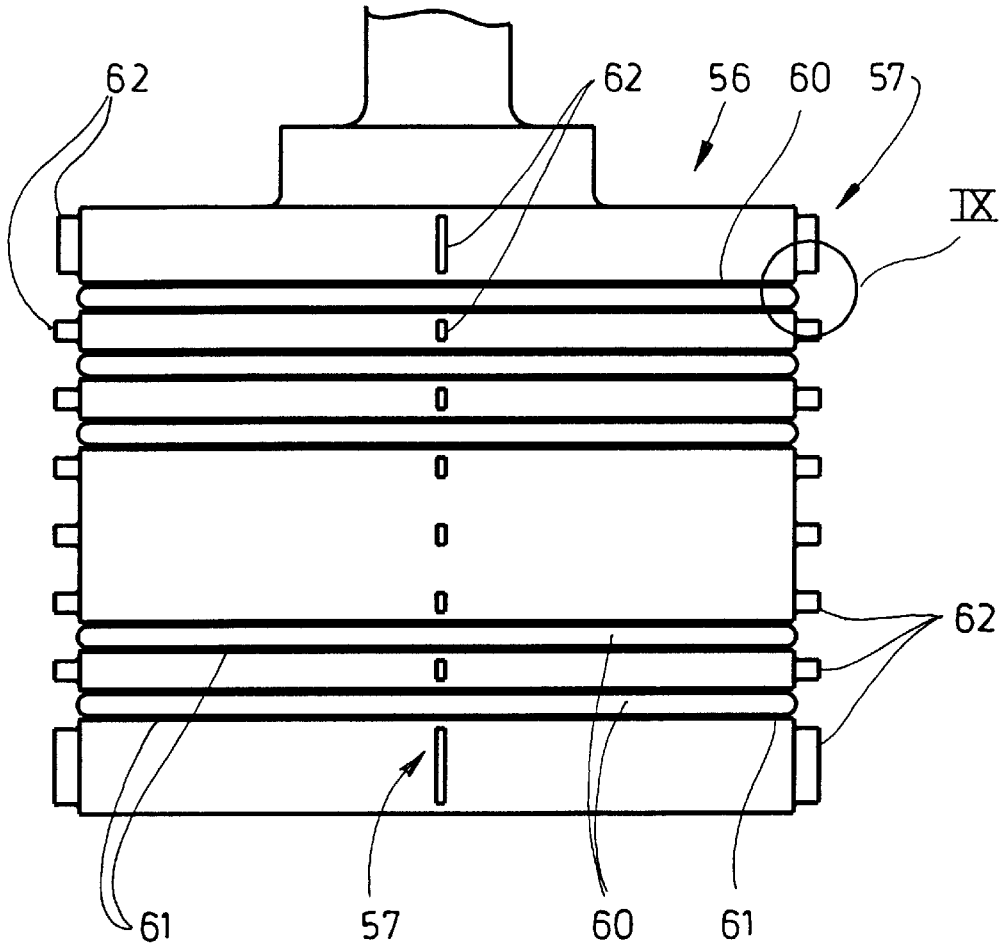
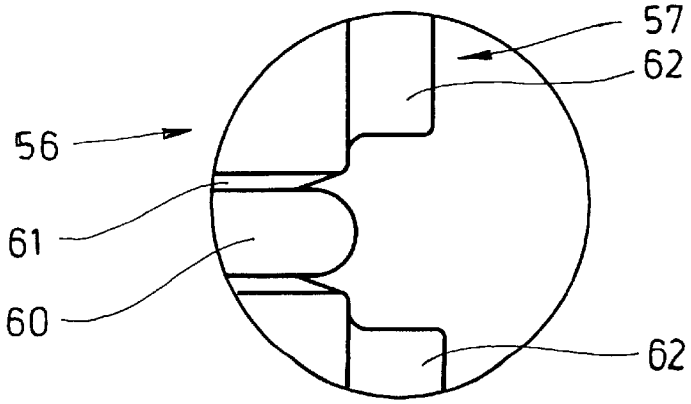
Fig. 9

PACKAGING MACHINE WITH A ROTARY FOLDING UNIT FOR MANUFACTURING (SOFT) POUCH-TYPE PACKETS FOR CIGARETTES

BACKGROUND OF THE INVENTION

The invention relates to a packaging machine with a rotary folding unit which is driven in rotation and has distributed along its perimeter a plurality of receptacles for blanks and/or packet contents, said receptacles being preferably (hollow) folding mandrels for manufacturing (soft) pouch-type packets for cigarettes, blanks, such as inner blanks made of tin foil or paper, or pouch blanks made of paper, being folded around the folding mandrel and temporarily fixed on same.

On fast-running packaging machines particularly for manufacturing cigarette packets, there is a problem with fixing blanks consisting of paper, tin foil or thin cardboard to or in receptacles of a folding unit preferably rotating continuously, before the blanks are preferably rotating continuously, before the blanks are dimensionally stable on the basis of folds and/or gluing. Particularly with (soft) pouch-type packets for cigarettes, one difficulty consists in holding first of all the inner blank made of paper or tin foil, and then the pouch blank made of paper, in an exact position on folding mandrels arranged along the perimeter of the rotary folding unit.

SUMMARY OF THE INVENTION

The object underlying the invention, therefore, is to develop a packaging machine or its rotary folding unit in such a way that, despite the high (continuous) rotation speed, the blanks are fixed on receptacles, especially folding mandrels, without the packaging process being impaired.

In achieving this object, the packaging machine according to the invention is characterised in that, at least in a partial region of the perimeter of the rotary folding unit, outside the movement path of the receptacles or folding mandrels, there are mounted continuous holding bands which lie with one holding bight adjacent to a plurality of receptacles or to the blanks, namely preferably to an inner blank or to a pouch blank on the outer side of a folding mandrel, and may be moved at the same speed and in the same direction as the receptacles.

According to the invention, therefore, along the perimeter of a rotary folding unit there are attached fixed holding members running along a partial stretch and in the form of continuous holding bands or belts which lie next to the receptacles or folding mandrels in the region of a free side of same, oriented radially towards the outside. Because these holding bands have the same drive in the same direction, the blanks are fixed to the receptacles or folding mandrels without friction.

The holding bands consist preferably of a plurality of parallel holding belts lying beside one another in the axial direction of the rotary folding unit, especially round cords made of resilient material. The holding belts are driven, in the region of a deflection roller acting as a drive roller.

The holding bands are so positioned that they grasp a blank attached to a folding mandrel immediately after a folding step has been completed, and thus fix the folded blank on the folding mandrel in the correct position for the packet. On the inner blank, folded first, of a pouch-type packet for cigarettes, there are two overlapping folding flaps on the outer side of the folding mandrel which is rectangular in cross-section.

The holding bands lie in this region adjacent to the folding mandrel or the inner blank, until the next pouch blank to be attached is led in. The latter is then fixed by further holding bands, in a region following the folding of side flaps which are glued and cover one another. In each case, the holding bands form part of a stationary holding assembly.

Further details and features of the invention relate both to the design of the holding bands or of holding assemblies, as well as to the configuration of folding members, especially for the production of pouch-type packets for cigarettes.

BRIEF DESCRIPTION OF THE DRAWINGS

An embodiment, given by way of example, of the device according to the invention is explained in greater detail below with the aid of the drawings. These show.

DESCRIPTION OF PREFERRED EMBODIMENTS

Figure 1:
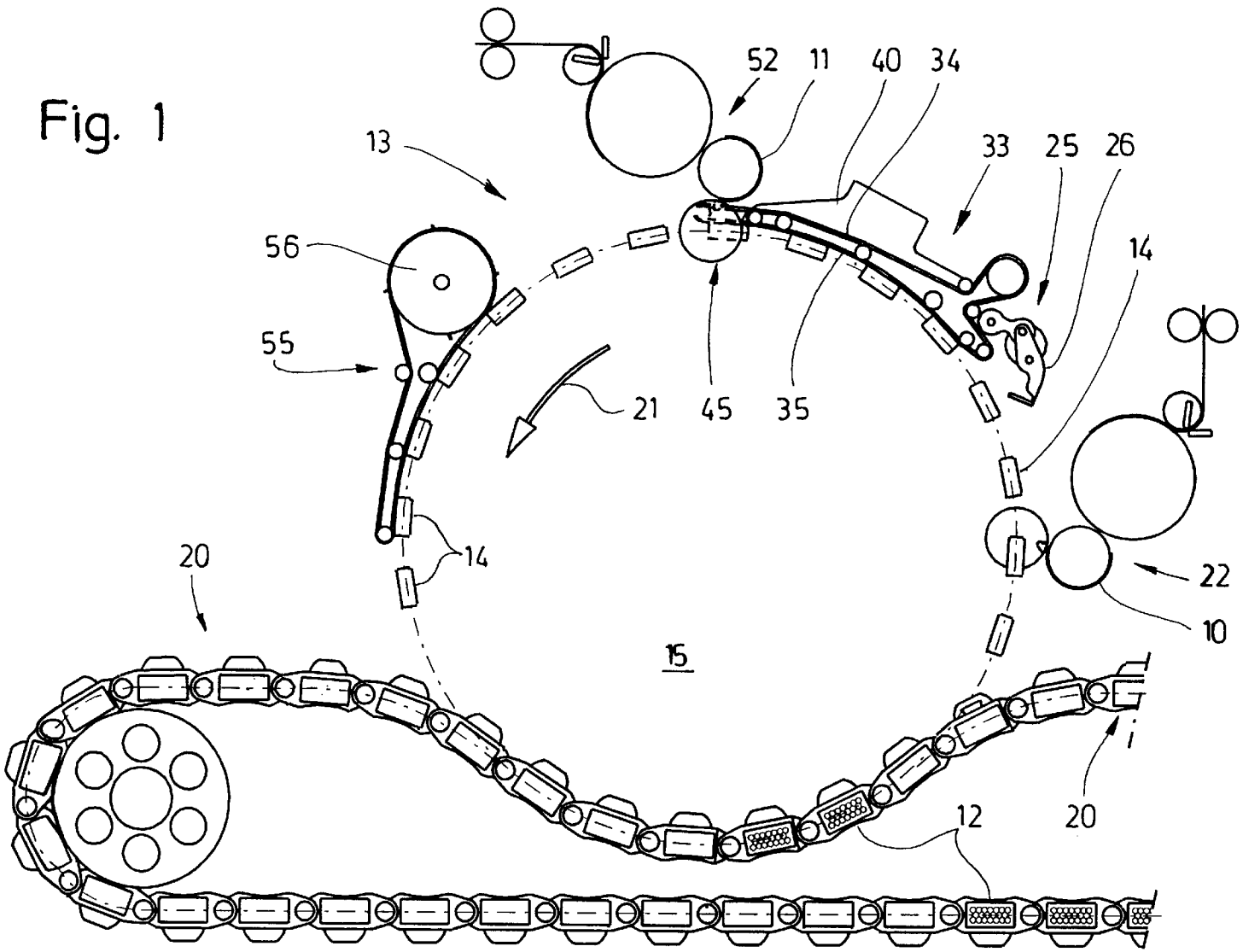
FIG. 1 a portion of a packaging machine, namely a rotary folding unit, in diagrammatic side view, FIG. 2 a detail of the rotary folding unit with a holding assembly for inner blanks, in side view and on an enlarged scale, FIG. 3 a detail of the holding assembly as per FIG. 2, on a further enlarged scale, FIG. 4 a cross-section through the arrangement as per FIG. 2 in the cutting plane IV—IV, on an enlarged scale, FIG. 5 a further detail of the holding assembly as per FIG. 2, in a radially aligned view according to arrow V in FIG. 2, likewise on an enlarged scale, FIG. 6 a further holding assembly with holding bands, in diagrammatic side view, FIG. 7 a detail of the holding assembly as per FIG. 6, on an enlarged scale, FIG. 8 a deflection roller for holding belts, serving as a folding member, in plan view, FIG. 9 a detail IX of the deflection roller as per FIG. 8, on a further enlarged scale.

In the drawings, regions of a packaging machine for the production of cigarette packets are shown as an embodiment. In concrete terms, what is concerned is the production of (soft) pouch-type packets. These usually consist of an inner blank 10 made of paper or tin foil, plus an outer or pouch blank 11 made of paper, or of thin cardboard, if necessary. The inner blank 10 completely encloses a group of cigarettes 12. The block of cigarettes formed in this way is enclosed by the pouch-shaped outer blank, namely the pouch blank 11, in such a way that the region of an end wall is open.

The (cigarette) packet is produced predominantly in the region of a rotary folding unit 13, only a few details of which are shown in the drawings. Around the outer perimeter of the rotary folding unit 13 there are arranged receptacles for the blanks and the packet contents, namely folding mandrels 14. These are known members, namely thin-walled hollow bodies which are rectangular in cross section and open at both ends. The folding mandrels 14 are disposed on a carrier of the rotary folding unit 13 projecting at one side, namely on a revolving disc 15. The folding mandrels 14 are so positioned that a large-surface outer wall 16 is directed radially towards the outside or runs approximately in the direction of the perimeter. A similar inner wall 17 is located opposite. Narrow front and back side walls 18, 19 extend transversely to the inner wall or approximately in a radial direction. The inner blank 10 and the pouch blank 11 are folded in succession on the outer side of the folding mandrels 14. The group of cigarettes 12 is held ready on the inner side. Said group is led towards the rotary folding unit 13 by a pocket chain 20 and pushed into the folding mandrel 14. The rotary folding unit 13 is preferably driven to rotate continuously (direction of rotation as per arrow 21). The structure of the rotary folding unit 13 and of the pocket chain 20 can, for example, correspond to EP 0 226 872 and EP 0 210 544.

The inner blanks 10 are led in succession to the folding mandrels 11 in the region of a transfer station 22. The inner blanks 10 are laid externally on to the folding mandrel 14 in such a way that, after a plurality of folding steps, edge flaps of the inner blank 10 are formed in the region of the outer wall 16, namely an outer flap 23 lying at the front in the direction of movement, and an inner flap 24 projecting transversely on the rear side of the folding mandrel 14. Outer flap 23 and inner flap 24 are to be positioned in such a way (FIG. 2, FIG. 3) that the outer flap 23 covers the inner flap 24 in a strip-shaped partial region.

For this purpose, first of all the rear inner flap 24, extending namely in the region of the rear side wall 19, is folded, against the outer wall 16. To this end, a special folding assembly 25 is provided which is positioned stationary outside the movement path of the rotary folding unit 13. The folding assembly 25 consists of a (two-armed) folding lever 26. This is mounted on a rotating actuating disc 27, with a pivotal bearing 28 off-centre to the fixed actuating disc 27. The free end of the folding lever 26 is connected via a joint 29 with a coupler 30. The latter is rotatably mounted as a one-armed lever in the region of a fixed bearing 31. The other end is connected via the joint 29 with the folding lever 26. Through the rotary drive of the actuating disc 27, the folding lever 26 carries out a folding movement. In the course of this, the folding lever 26 is moved out of a recessed initial position (FIG. 2) aligned radially towards the outside, in a folding movement running behind in relation to the folding mandrel 14, in such a way that a folding finger 32, which is transverse or points in the direction of the perimeter of the rotary folding unit 13, on the end of the folding lever 26, grasps the inner flap 24 which is aligned (approximately) radially and folds it against the outer wall 16 of the folding mandrel 14 during continued rotation of the rotary folding unit 13.

Figure 2:
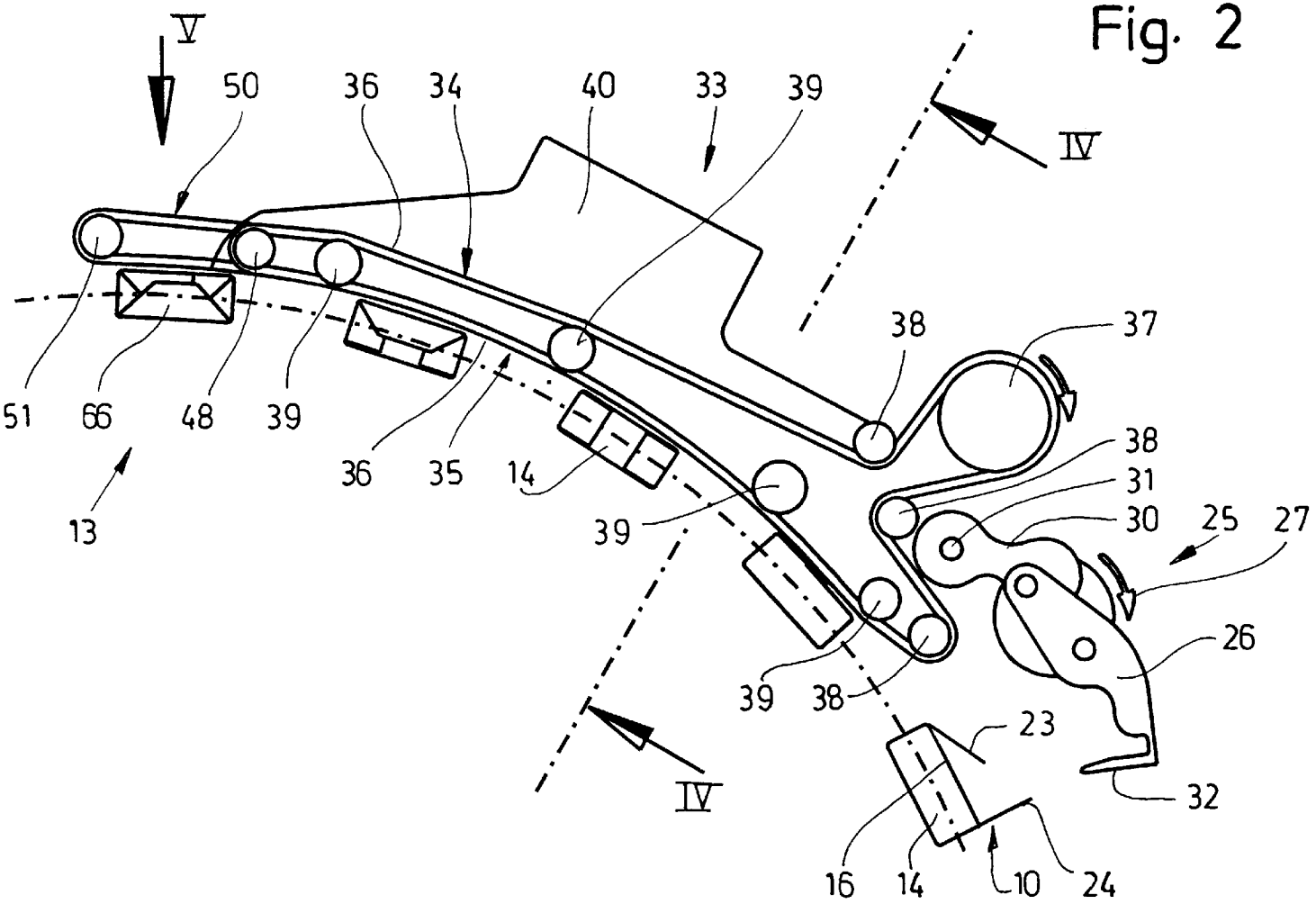
Figure 3:
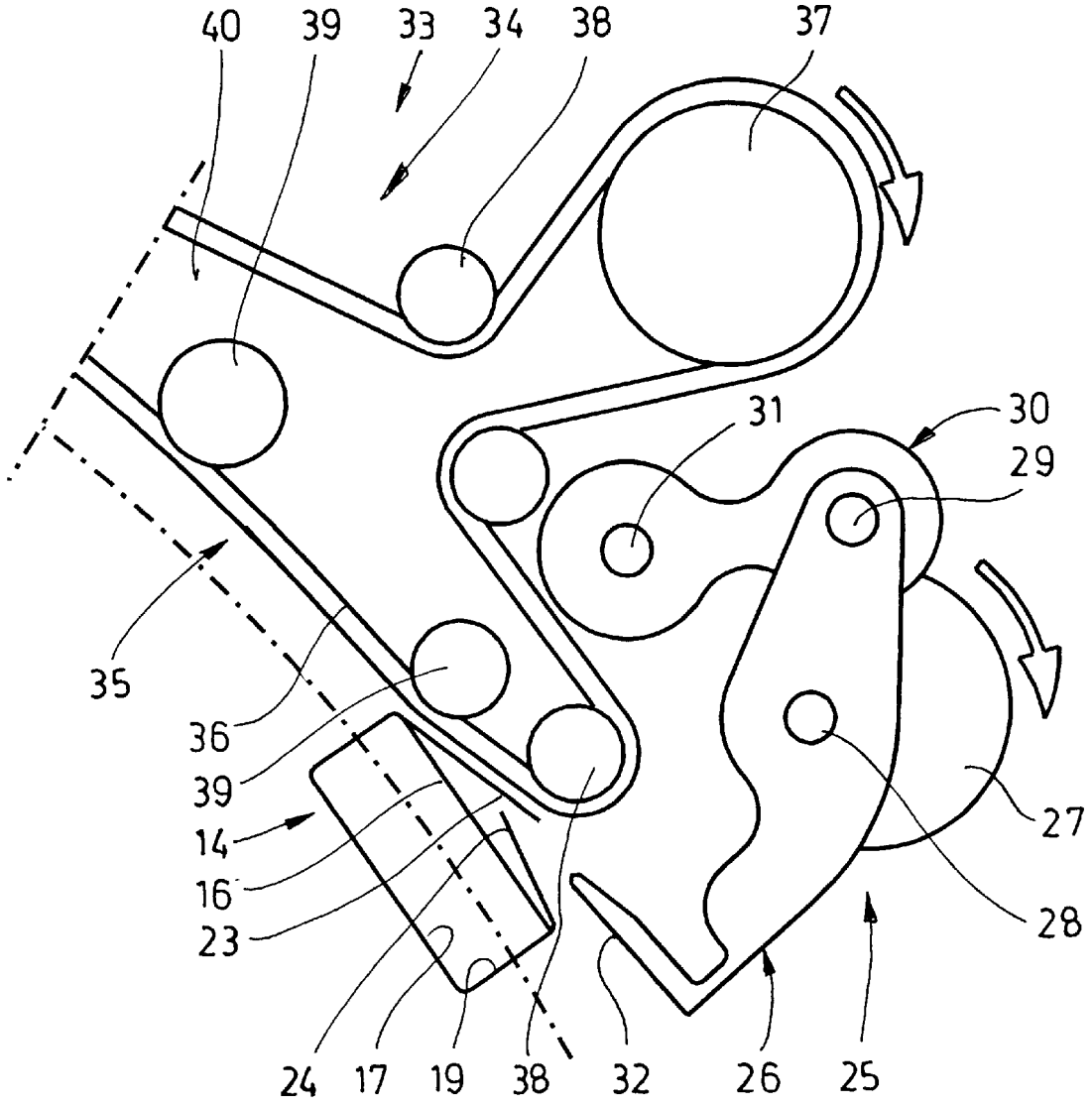

During this movement phase, the relevant folding mandrel 14 has reached the entrance region of a holding assembly 33. The latter has above all the task of fixing on to the folding mandrel 14 the inner blank 10 which, having been folded in the described manner, is now lying next to the folding mandrel 14. To this end, the holding assembly has holding bands 34 which lie with a holding bight 35 adjacent to the folding mandrels 14 or to the blanks arranged on same. The holding band 34 or its holding bight 35 extend over a perimeter region of the rotary folding unit 13 which corresponds to a plurality of folding mandrels 14, four on the present embodiment, given by way of example (FIG. 2).

Figure 4:
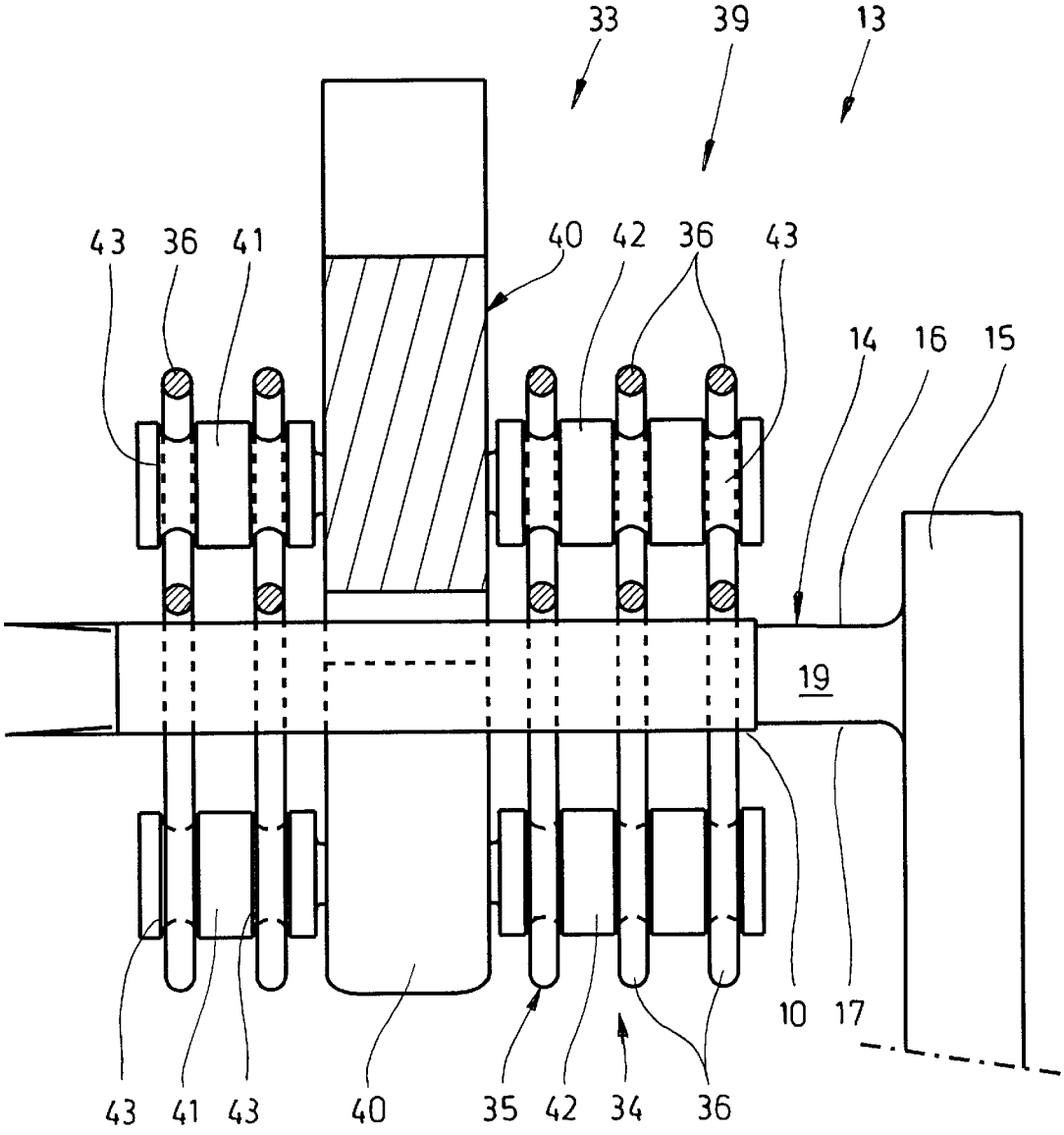
Figure 5:
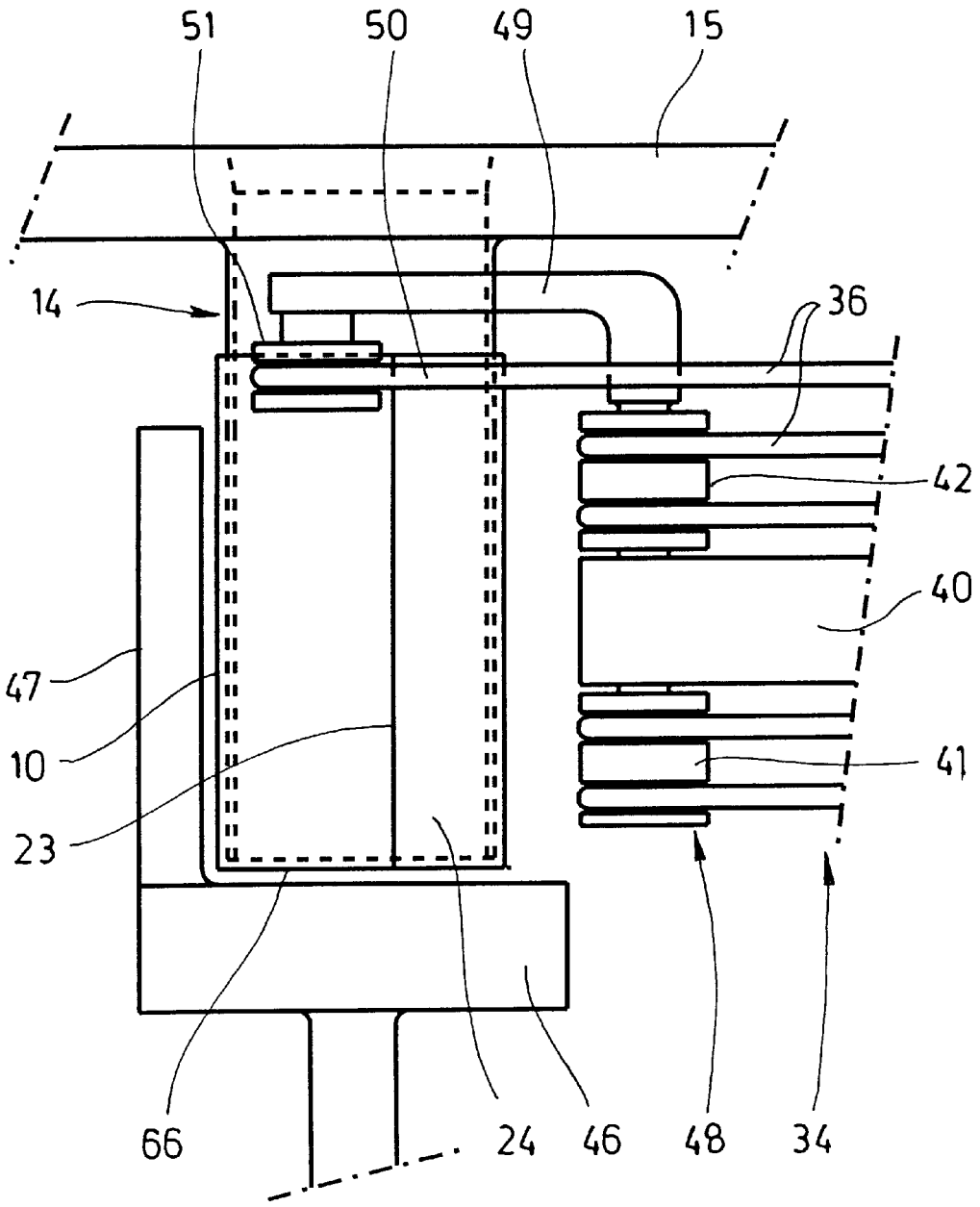

For optimum fixing of the inner blank 10 on the folding mandrel 14, especially for fixing the folding flaps 23, 24 overlapping one another, the holding band 34 consists of a plurality of individual belts arranged beside one another in an axial direction and configured as a round cord 36 on the present embodiment. Each round cord 36 consists of a resilient material such as rubber or plastic. In addition, each round cord 36 forms a holding bight 35, such that on the embodiment (FIG. 4), given by way of example and shown here, altogether five round cords 36 lie adjacent to the folding mandrel with their holding bight 35.

The holding band 34 or the round cords 36 forming same is/are driven, in such a way that the holding bight 35 is driven in the same direction and at exactly the same speed as the rotary folding unit 13 or the folding mandrels 14. Accordingly, the round cords 36 lie without slipping on the folding mandrel 14 or on a blank during the rotary movement of the rotary folding unit 13. On the holding assembly 33, the holding band 34 is driven by a drive roller 37 around the perimeter of which the round cords 36 are led.

The round cords 36 are carried via a plurality of deflection rollers 38 and guide rollers 39 on a mount, namely on a fixed carrying wall 40. The latter extends over a partial region of the perimeter of the rotary folding unit 13 and is connected to a portion of the machine frame. The carrying wall 40 is in the present case so positioned that round cords 36 are disposed on both sides of this carrying wall 40. To guide and hold said cords, partial rollers 41, 42 are accordingly in each case mounted rotatably on opposite side surfaces of the carrying wall 40. These partial rollers are positioned coaxially and together form the deflection roller 38 or a guide roller 39. An important function of these deflection rollers 38 and guide rollers 39 is to guide the round cords 36 in respect of sideways movements, i.e. creating a lateral guideway for the round cords 36. To this end, the round cords 36 lie against the deflection rollers 38 and guide rollers as a form-fit, on the present embodiment, given by way of example, in suitably configured trough-shaped grooves 43 of the rollers or partial rollers.

At the entry side of the holding assembly 33, adjacent to the folding assembly 25, a run-in slope 44 of the holding band or of the round cords 36 is formed by a deflection roller 38 which is correspondingly offset in a radial direction. By this means, an additional task of the holding assembly 33 is made easier, namely folding the outer flaps 23, lying at the front in the conveying direction, against the folding mandrel 14 or against the previously folded inner flap 24 by means of the holding bight 35 of the holding band 34.

A further special characteristic is realised on the opposite exit side of the holding assembly 33. There, a blank member 45 acts to lead in, hold and transfer a subsequent blank, namely the pouch blank 11, to the folding mandrel 14. The blank member 45 consists of a fixed rotating suction disc 46 and a holding finger 47 arranged off-centre to same for the pouch blank 11. The holding finger 47 carries out a movement around the folding mandrel 14 during the transfer of the pouch blank 11. For this reason, the holding band 34 or the round cords 36 ends/end at a distance from the rotation region of the fixed member acting here, namely the holding finger 47. A deflection roller serving as an end roller 48 for the round cords 36 is arranged at the end of the carrying wall 40.

To continue a certain supporting effect on the inner blank 10 even beyond the end roller 48, at the side and outside the working or movement region of the holding finger 47, a single lateral round cord 36 is configured with an extension 50. The latter extends directly into the region of transfer of the next blank in succession, i.e. of the pouch blank 11. The extension 50 of the round cord 36 lies against a free region of the inner blank 10 facing the revolving disc 15, outside the effective region of the holding finger 47.

With the extension 50 there is associated a single roller 51 to provide deflection. This roller is mounted at the end of a carrying arm 49 which is offset at 90°. The latter is in turn connected to a (fixed) axis of the end roller 48.

The (additional) blank taken over by the folding mandrel 14, namely the pouch blank, 11 is led via a feed assembly 52—preferably in an embodiment according to DE 196 44 079.3—to the rotary folding unit or the folding mandrels 14. The pouch blank 11 is taken over by the folding mandrel 14 in such a way that on the rear side, namely in the region of rear side walls 19, folding flaps of the pouch blank 11 project over the folding mandrel 14. These flaps are an inner side flap 53, lying radially on the outside and folded first, and an outer side flap 54 which is to be folded against the inner side flap 53.

Figure 6:
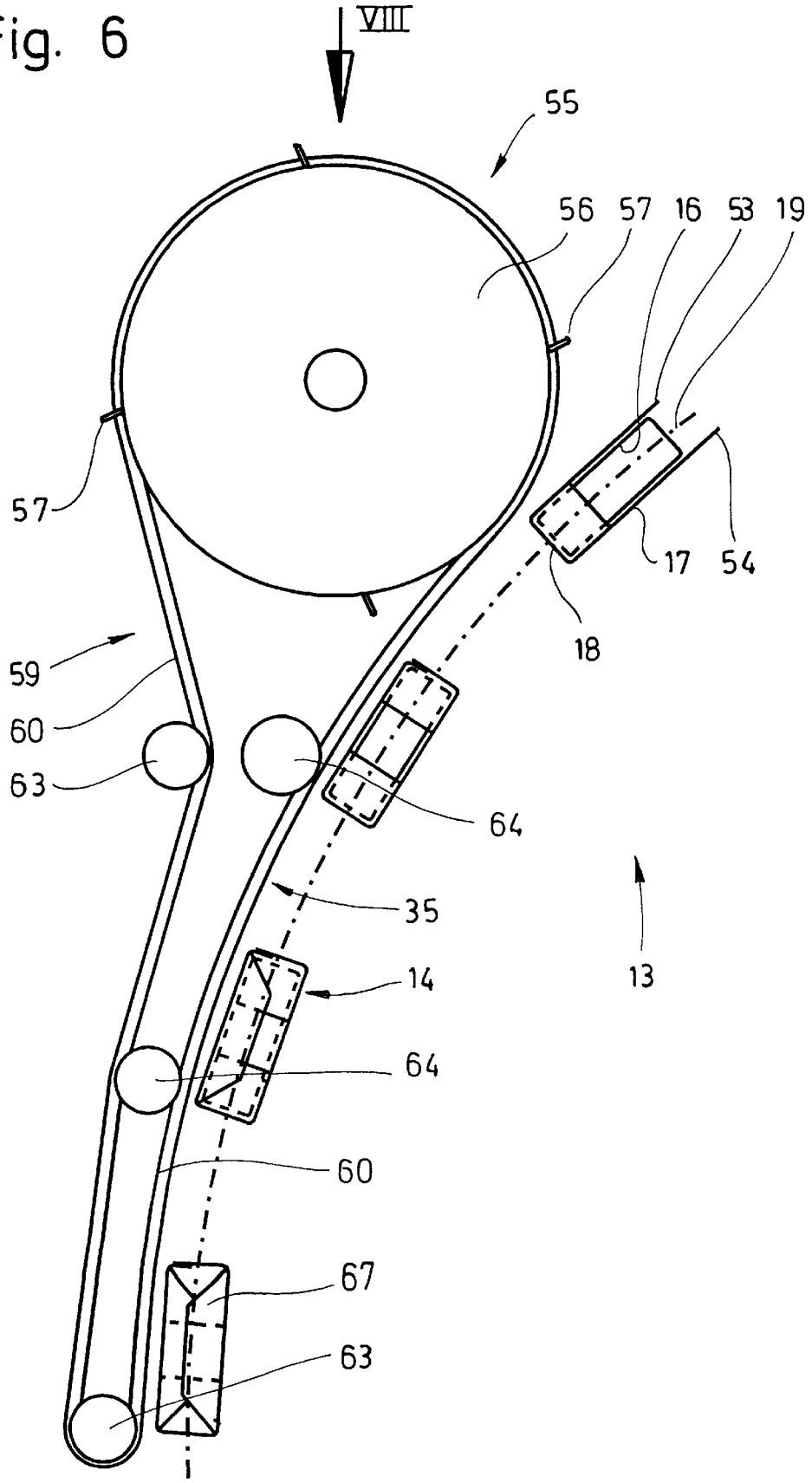
Figure 7:
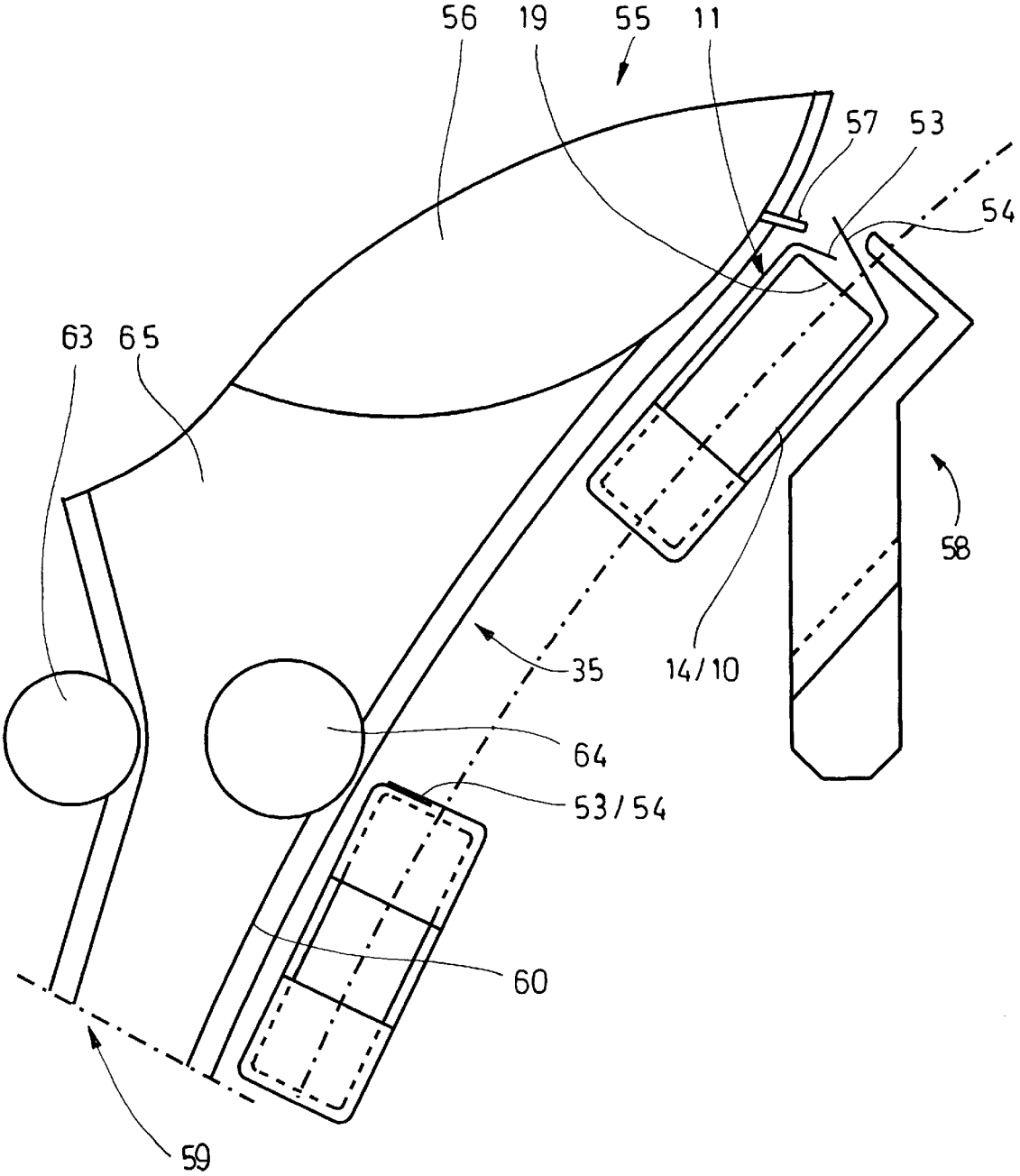

In the position arising, for example, from FIG. 6, at the top, glue is applied to the side of the inner side flap 53 which points radially towards the outside, preferably a row of glue spots. Thereafter the folding mandrel 14 with the pouch blank 11 reaches the region of a folding and holding assembly 55. The latter has at the entry side a folding member to fold the inner side flap 53 round against the rear side of the folding mandrel 14. The folding member is in the present case a folding roller 56 with a comparatively large diameter. On the perimeter of this folding roller 56 there are arranged folding means, namely folding webs 57 aligned approximately radially. The latter grasp a side flap 53 during the rotary movement which is coordinated with the movement of the folding mandrels 14 and fold this side flap round against the side wall 19 of the folding mandrel 14. In order to ensure trouble-free folding, the folding webs 57 are not positioned exactly in radial planes but at an acute angle to the (imagined) radial plane (FIG. 7). Along the perimeter of the folding roller 56, there are positioned a plurality of such folding webs, in this case four, at equal peripheral distances from one another.

Immediately after the inner side flap 53 has been folded over, a folding lever 58, configured angular, becomes effective and presses, on the basis of corresponding movement relative to the folding mandrel 14, the outer side flap 54 likewise against the side wall 19 of the folding mandrel 14 or against the already folded side flap 53. The folding lever 58 is described in detail in DE 196 41 151.3.

In the course of a subsequent conveying section, the pouch blank 11, folded in the described manner, is fixed on the folding mandrel 14 by a holding band 59 of the folding and holding assembly 55. This holding band 59 also consists of a plurality of round cords 60, namely five, lying beside one another and which are configured in the same manner as on the holding assembly 33. The folding roller 56 serves at the same time as a deflection and drive roller for the round cords 60. On its circumference, the folding roller 56 is to this end provided with grooves 61 into which the round cords 60 plunge completely, such that they lie roughly flush with a cylindrical casing surface of the folding roller 56 outside the region of the grooves 61.

Because of the dual function of the folding roller 56, the folding members, namely folding webs 57, are configured as partial webs 62. The latter are positioned respectively outside the region of the round cords 60 or of the grooves 61, aligned in an axial direction, with the result that the partial webs 62 together form a folding web 57.

For the rest, the round cords 60 of the folding and holding assembly 55 are disposed, led and supported in a comparable manner to that on holding assembly 33, namely using deflection rollers 63 and guide rollers 64. In addition, a carrying wall 65 is provided which is likewise configured in an analogous fashion.

After the folding and holding assembly 55, the pouch-type packets, which are now largely completed, are drawn off the folding mandrel 14 in known fashion and simultaneously filled with the group of cigarettes 12.

Whilst the blanks are being conveyed, namely inner blank 10 on the one hand, and pouch blank 11 on the other hand, further steps are carried out on the blanks by the folding mandrels 14 in the region of the holding assembly 33 on the one hand, and of the folding and holding assembly 55 on the other hand. In the region of the holding assembly 33, a base wall 66 of the inner blank 10 is folded by known folding members not shown here. In the region of the folding and holding assembly 55, a pouch base 67 is correspondingly formed by folding flaps folded in envelope fashion.

What is claimed is:

1. A packaging machine for the manufacture of pouch packs for cigarettes, comprising a rotary folding unit (13) which is driven in rotation and which has a plurality of holding devices distributed along its perimeter for holding blanks used in the manufacture of the packs and for accommodating pack contents, wherein:

a) the holding devices are hollow folding mandrels (14) upon whose outer side lie the blanks;

b) at least along one partial region of the perimeter of the rotary folding unit (13), endless holding bands (34, 39) are stationarily mounted outside a movement path of the folding mandrels (14);

c) the holding bands (34, 59) each lie with a holding bight on regions, located on the outside in the radial direction of the folding unit (13), of a plurality of successive ones of said folding mandrels (14) to temporarily fix the blanks (10, 11), positioned on the folding mandrels, (14) during the rotary movement of the folding unit (13);

d) there is provided means for moving the holding bands (34, 59) at the same speed and in the same direction as the folding mandrels; and e) the holding bands (34, 59) comprise a plurality of parallel belts, disposed beside one another in the axial direction of the folding unit (13), said holding bands lying with a holding bight (35) thereof next to the folding mandrels (14).

2. The packaging machine according to claim 1, characterised in that the holding bands (34, 59) are disposed in a region of folding assemblies (25, 56) to fold the blanks (10, 11) on the folding mandrels (14).

3. The packaging machine according to claim 1, characterised in that the holding bands (34, 59) form part of a folding and holding assembly (55), which is mounted fixed outside a movement region of the rotary folding unit (13), with a carrying wall (40, 65) as a mount for carrying deflection rollers (38, 63) and guide rollers (39, 64).

4. The packaging machine according to claim 3, characterised in that the deflection rollers (38, 63) and guide rolles (39, 64), projecting on one side, extend on opposite sides of the carrying wall (40, 65).

5. The packaging machine according to claim 1, characterised in that the holding bands (34, 59) are led in a lateral direction, parallel to the rotation axis of the rotary folding unit (13), by positive support on deflection rollers (38, 63) and guide rollers (39, 64).

6. The packaging machine according to claim 1, characterised in that the holding bight (35) is supported and guided by a plurality of guide rollers (39, 64) mounted to correspond to a contour of the rotary folding unit (13).

7. The packaging machine according to claim 1, characterised in that, at an exit end of the holding bands (34, 59), a single belt (36) has an extension (50) which extends beyond an exit end roller (48) of the holding bands (34, 59), and which runs over a single roller (51) offset from the exit end roller (48).

8. A packaging machine according to claim 1, characterised in that a folding roller (56) for the blanks is integrated into a folding and holding assembly (55).

9. The packaging machine according to claim 8, characterised in that the folding roller (56) has distributed along its perimeter a plurality of folding webs (57) for folding a side flap (53), lying radially on an outside, against a rear side of each folding mandrel (14), the folding webs (57) being sub-divided into a plurality of partial webs (62) which are disposed between round cords (60) of the holding bands (59).

10. A packaging machine comprising a rotary folding unit (13) which is driven in rotation and which has distributed along its perimeter a plurality of folding mandrels (14) on which blanks for manufacturing packets are adapted to be folded, wherein:

at least along a partial region of the perimeter of the rotary folding unit (13), there are provided continuous holding bands (34, 59) which are mounted stationary outside a movement path of the folding mandrels (14), and which each lie with a holding bight on regions, lying on the outside in a radial direction, of a corresponding plurality of successive ones of said folding mandrels (14), to temporarily fix the blanks (10, 11) positioned on the folding mandrels (14) during the rotary movement of the rotary folding unit (13);

there is provided means for moving the holding bands (34, 59) at the same speed and in the same direction as the folding mandrels (14);

a folding roller (56) for blanks is integrated into a folding and holding assembly (55); and the folding roller (56) has distributed along its perimeter a plurality of folding webs (57) for folding a side flap (53), lying radially on an outside, against a rear side of each folding mandrel (14), the folding webs (57) being sub-divided into a plurality of partial webs (62) which are disposed between round cords (60) of the holding bands (59).

* * * * *